United States Patent [19]

Kiefer

[11] 4,051,978

[45] Oct. 4, 1977

[54] MERCHANDISE COMPARTMENTING ARRANGEMENT FOR AN AUTOMATIC VENDING MACHINE

[75] Inventor: Josef Kiefer, Herrieden, Germany

[73] Assignee: Sielaff GmbH & Co. Automatenbau Herrieden, Herrieden, Germany

[21] Appl. No.: 648,803

[22] Filed: Jan. 13, 1976

[30] Foreign Application Priority Data

Jan. 23, 1975 Germany ..... 2502626

[51] Int. Cl.[2] ..... B65H 1/00

[52] U.S. Cl. ..... 221/197

[58] Field of Search ..... 221/197, 198, 287

[56] References Cited

U.S. PATENT DOCUMENTS

| | | | |
|---|---|---|---|
| 2,784,621 | 3/1957 | Klingler | 221/198 X |
| 3,486,658 | 12/1969 | Cheslak et al. | 221/197 |
| 3,787,052 | 1/1974 | Glass et al. | 221/197 X |

*Primary Examiner*—Robert B. Reeves
*Assistant Examiner*—Francis J. Bartuska
*Attorney, Agent, or Firm*—Haseltine, Lake & Waters

[57] ABSTRACT

A merchandise compartmenting arrangement for an automatic vending machine of merchandise packages, including actuating installations associated with the merchandise compartments for the dispensing of the merchandise packages, in which at least one, and particularly a plurality of merchandise compartments are constructed as a self-contained unit independent of the automatic vending machine, and which is fillable externally of the automatic vending machine, separately transportable from the latter, and insertable into the automatic vending machine for the filling thereof whereby, in the inserted position of the unit, the merchandise packages of the merchandise compartments are individually dispensable by means of the actuating installation through a dispensing aperture provided in the unit.

10 Claims, 4 Drawing Figures

MERCHANDISE COMPARTMENTING ARRANGEMENT FOR AN AUTOMATIC VENDING MACHINE

FIELD OF THE INVENTION

The present invention relates to a merchandise compartmenting arrangement for an automatic vending machine of merchandise packages, including actuating installations associated with the merchandise compartments for the dispensing of the merchandise packages, in which at least one, and particularly a plurality of merchandise compartments are constructed as a self-contained unit independent of the automatic vending machine, and which is fillable externally of the automatic vending machine, separately transportable from the latter, and insertable into the automatic vending machine for the filling thereof whereby, in the inserted position of the unit, the merchandise packages of the merchandise compartments are individually dispensable by means of the actuating installation through a dispensing aperture provided in the unit.

Automatic vending machines are located by firms or plants which must service a large number of automatic vending machines. The working period which is required for the filling of an automatic vending machine is of particular significance to such firms. The filling of automatic vending machines which are common in actual practice is a time-consuming procedure since the merchandising packages must be introduced more or less singly into the merchandising compartments of the automatic vending machine at the current location of the latter.

DISCUSSION OF THE PRIOR ART

In order to render more efficient the filling of automatic vending machines, in German Petty Patent, 1,869,584 it has been proposed that the merchandise compartments be assembled through the use of braces or cross bars into a compartment basket which, in a suitable manner, may be removably suspended within the automatic vending machine. The transportation of such a compartment basket must be carried out with extreme care since the merchandise stacks contained within the merchandise compartments, or respectively the individual merchandise packages, can easily drop out. As a consequence, the range of application of the compartment baskets is limited. The same restriction pertains to the automatic vending machine which is disclosed in German Published Patent Specification 2,143,651.

SUMMARY OF THE INVENTION

Accordingly, it is an object of the present invention to provide a merchandise compartmenting arrangement of the above-mentioned type, in which the merchandise packages are secured against falling out during transportation thereof without hereby preventing dispensing in the inserted position. For the uniform merchandise dispensing by the automatic vending machine, the required position of the merchandise stacks should nevertheless be maintained notwithstanding the different movements of the unit during transportation.

An inventive merchandise compartmenting installation is hereby characterized in that the compartment unit encompasses the merchandise stack in the transport position thereof and wherein, in the transport position, the dispensing aperture is closed by means of a cover or closure member which is movably mounted on the unit. In this manner, there is achieved that, during the transporting of the unit, the merchandise stacks are enclosed to such an extent so as not to be able to drop out during unavoidable transportation movements. It is hereby advantageous that the unit be adapted for conveyance in delivery trucks.

In a preferred embodiment of the invention, the unit encompasses a number of merchandise compartments whose multiplication corresponds, in particular, to a doubling of the number of the merchandise compartments provided in the automatic vending machine. In the last mentioned instance, the automatic vending machine may be completely newly refilled through the insertion therein of two units.

Preferably the dispensing aperture of the unit automatically opens, or respectively closes, during the change thereof from the transport position into the inserting position, meaning, upon insertion of the unit into the automatic vending machine, or respectively, upon the changing from the inserting position into the transport position, or meaning upon withdrawal of the unit from the automatic vending machine.

In a preferred embodiment of the invention, the unit includes a slidably displaceable cover or closure plate which leaves open the dispensing aperture in the inserted position of the unit, and covers the aperture in the transport position. In order to provide an indication of the current fill condition, the closure plate is provided with viewing apertures in the area of the merchandise compartments.

The automatic opening, or respective closing, of the dispensing aperture may be attained in that the closure plate, in the inserted position of the unit, is supported by means of a bracket device for holding open the dispensing aperture and, upon release from the bracket device, closes the dispensing aperture.

The closure plate covers the merchandise compartments of the unit at the front side thereof, and is removable for facilitating the filling of the merchandise compartments.

A further advantage of the invention is that a coin collecting box may constitute a component of the unit. At the exchange of an emptied, or substantially emptied unit, the collecting box may be concurrently exchanged therewith. Hereby, accounting or calculating procedures become superfluous at the plate of location of the coin-operated vending machine. The accounting can be carried out in the office or plant of the operator of the automatic vending machine. The accounting is thereby simplified in that there is precluded any loss during transportation and during filling.

The invention may be utilized in connection with push button, pull button or slide draw automatic vending machines.

BRIEF DESCRIPTION OF THE DRAWINGS

Further advantages and details of the invention may now be ascertained from the following detailed description of an exemplary embodiment thereof, taken in conjunction with the accompanying drawings; in which.

DETAILED DESCRIPTION

Figure 1:
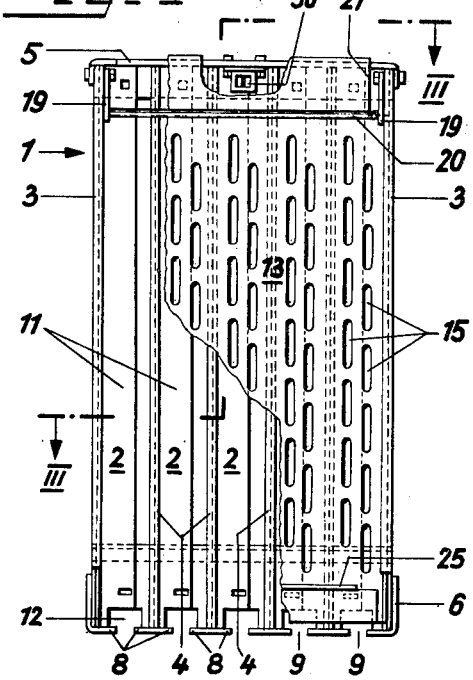
FIG. 1 shows a front view, partly broken away, of a construction unit having five merchandise compartments in the transporting position thereof.
Figure 3:
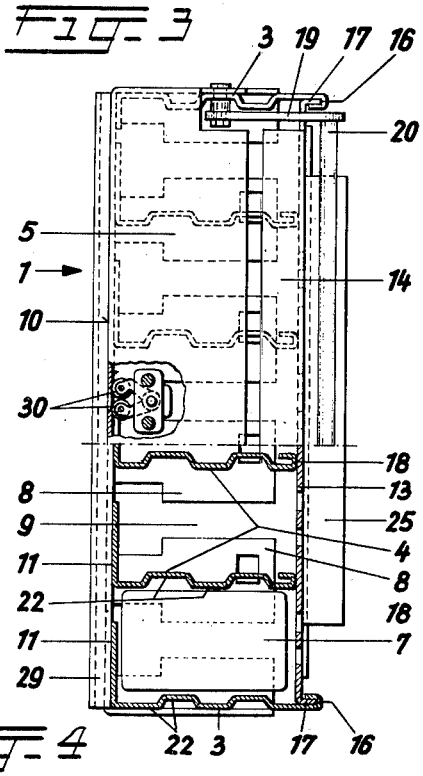
FIG. 3 shows an enlarged scale sectional plan view of the unit taken along line III—III in FIG. 1.

A construction unit 1 consists of five adjoiningly located merchandise compartments 2. The unit 1 is bounded on the side by two side walls 3. The merchandise compartments 2 are separated from each other by means of partitions 4. Provided for the connection of the side walls 3 and the partitions 4 is an upper cross bar member 5 and a lower cross bar member 6. The merchandise packages 7 are supported from below on crosspieces 8. Intermediate the crosspieces 8 there remain free slots 9. These slots are dimensioned so small that, in the transport position of the unit 1 and at the tilting over of a merchandise package itself, the latter cannot pass through a slot 9.

The rear side 10 of the unit 1 is closed off to such an extent that no merchandise packages 7 can drop out therefrom. This is achieved through angled portions 11 of the side walls 3 and of the partition walls 4. Provided in the rear side 10, and the lower cross bar member 6, are cutouts 12 which connect to the slots 9.

Along the front side, the merchandise compartments 2 are covered by a slidably displaceable closure plate 13. The closure plate at its top is provided with an angled section 14. This section, in the transport position of the unit (compare FIG. 1), lies on top of the partitions 4. The closure plate 13 is provided with viewing apertures 15 in the region of each merchandise compartment, through which there can be ascertained the filling condition of the merchandise packages in each particular merchandise compartment 2.

The two side walls 3 are extended further forwardly than the partitions 4 and are bent over inwardly at their forward edges to form guides 16 in which are located forwardly projecting angled portions 17 of the closure plate 13. The angled portions 17 are slidable within the guides 16. The closure plate 13 lies with its interior against the front edges 18 of the partitions 4.

Pivotally supported near the top on the inside of the sidewalls 3 are brackets 19. These brackets are connected at their free ends by means of a rod 20. The rod 20 forms a handgrip. The closure plate 13 is provided with cutouts 21 for the brackets 19.

So that the unit is as light as possible in weight, but is also stable, the sidewalls 3 and the partitions 4 are provided with profiled reinforcement portions 22 in the longitudinal direction thereof.

An automatic vending machine 23 is provided with a cross bar member 24 extending along the front side thereof. This is utlized as a stop for a support member 25 which is fastened to the closure plate 13.

Figure 2:
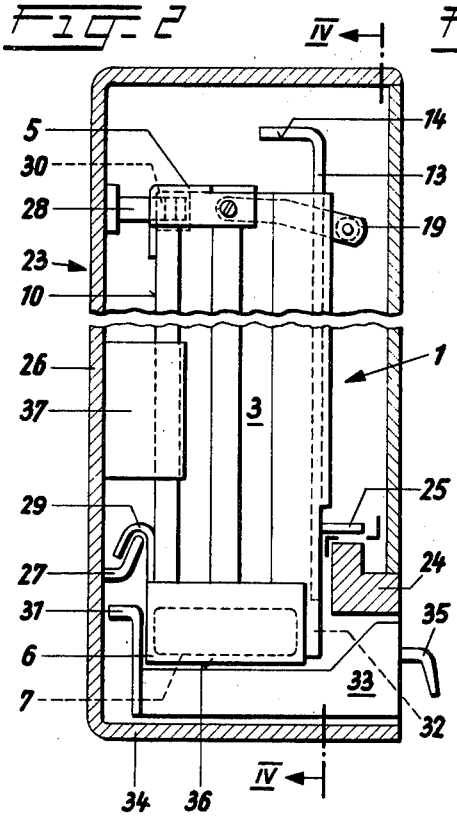
FIG. 2 shows a side view of the unit of FIG. 1 in its inserted position within an automatic vending machine.

Arranged on the inside of the back wall 26 of the automatic vending machine 23 is a support arrangement for the unit 1. This arrangement consists of a support 27 in the lower region and a fastening element 28 in the upper region. The latter becomes effective upon pressing of the unit against the back wall. A rail 29 is formed on the back side 10, at the lower cross bar member 6 of the unit 1, which extends over the support 27 (FIG. 2). The fastening element 28 consists of a projection provided on the back wall 26 and of two resilient rollers 30 on the upper cross bar member 5 which encompass this projection. These rollers snap over the projection upon the pressing of the unit against the back wall of the automatic vending machine.

A merchandise slide ejector 31 is located in the automatic vending machine 23 for the dispensing of the merchandise packages from each merchandise compartment 2. The support 27 and the rail 29 are so arranged whereby the merchandise ejector 31 can slide out a merchandise package through the recesses 12 from the therewith associated merchandise compartment 2.

In the inserted position of the unit, the closure plate 13 is pushed upwardly by means of the support member 25 which is positioned on the cross bar member 24, so as to open a dispensing aperture 32 in the lower region of the unit 1. This aperture is at least as high as a merchandise package.

As shown in FIG. 2 of the drawings, the automatic vending machine 23 is provided with merchandise dispensing drawers 33. These drawers each respectively carry at their rear sides the merchandise ejector 31. The merchandise dispensing drawers 33 are displaceably supported on a support 34 which is rigidly interconnected with the automatic vending machine. At the front side of the merchandise dispensing drawer 33 there is mounted a pull handle 35. The crosspieces 8 of the unit 1 lie closely above the bottoms 36 of the merchandise dispensing drawers 33. When, for merchandise dispensing, the sliding drawer 33 is pulled out by means of the pull handle 35, the merchandise ejector 31 then passes through the cutout 12 and the slot 9 in the unit , and slides a merchandise package 7 forwardly through the dispensing aperture 32 and into the drawer. The merchandise may then be removed from the slide drawer.

Furthermore, provided on the back wall 26 of the automatic vending machine 23 are downwardly inclined guide surfaces 37. Upon insertion of the unit 1 into the automatic vending machine 23, these surfaces lead to the correct association of the merchandise compartments 2 with the merchandise ejectors 31 and the merchandise dispensing slide drawers 33.

Figure 4:
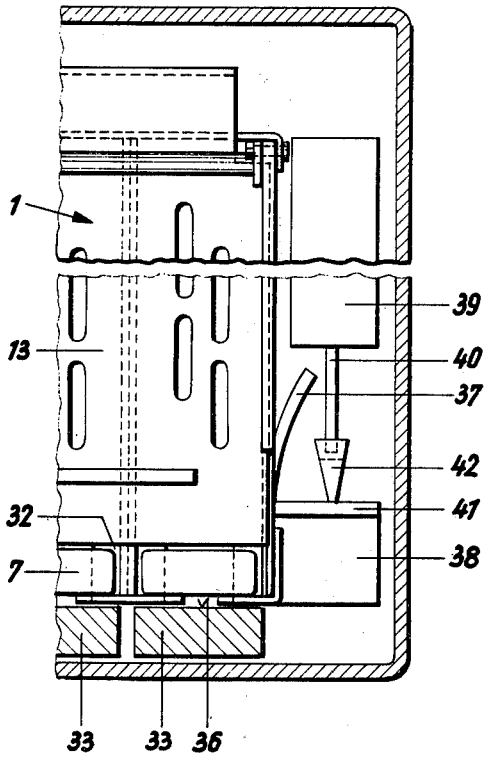
FIG. 4 shows an enlarged scale sectional view of a modified construction of the unit having a cash box built thereon.

Illustrated in FIG. 4 of the drawing is a modified embodiment of the unit 1 which, in addition to the merchandise compartments 2, also includes a coin collecting box 38. In the usual slide drawer-automatic vending machines, the coin collecting box is located as a separate open receptacle below the slide drawers. Arranged above the coin collecting box is a coin proof and release arrangement 39. Connected with the latter is the coin collecting box through the intermediary of a coin passageway 40. For the construction pursuant to FIG. 4, the coin collecting box and its associated devices are displaced so far upwardly, that the coin collecting box 38 directly connects to the unit 1. The coin collecting box 38 is constructed either integrally with the unit 1, or connected to the latter through suitable fastener means.

The coin collecting box 38 is provided with a closed cover 41 and with an inlet funnel 42. The wall edge which faces towards the coin passageway 40 inclines upwardly and forwardly. Correspondingly inclined is the lower edge of the coin passageway 40. It is possible for coin box 38 to be pivoted out, together with the unit 1, from below the coin passageway so as to be removed from the automatic vending machine 23.

The operation of the described unit is essentially as follows:

When the unit 1 is filled in the plant of the vending machine operator, it can then be transported to the place of location of the automatic vending machine which is to be filled. Hereby, the merchandise compartments 2 are closed off by means of the closure plate 13 over their entire height. No aperture is so large whereby the merchandise packages can fall out or slide out therefrom.

At the place of location of the automatic vending machine, after withdrawal of an emptied or substantially emptied unit, there is then inserted a filled unit. For this purpose, the unit in inserted inclinedly from above into the automatic vending machine. The support member 25 of the closure plate 13 contacts the cross piece member 24 and slides the cover plate 13 upwardly. The rail 29 comes into position on the support 27 and the unit 1 is pressed so far rearwardly as to be positioned fast on the fastening element 28.

Should the unit again be later on removed from the automatic vending machine, then the unit is gripped by means of the handgrip 20 and thereafter, upon releasing of the fastening element 28, inclined forwardly and lifted by the handgrip 20 out of the automatic vending machine. Hereby, the closure plate 13 closes the dispensing aperture 32 inasmuch as it will slide downwardly under its own weight within the guides formed by the front edges 16. The unit 1, together with the coin receptacle 38, is then brought into the plant of the operator of the automatic vending machine.

The unit, in particular the portion thereof encompassing the merchandise compartments, and upon occasion the coin receptacle, consists of sheet metal. However, it can also be constructed as a plastic material element.

An important advantage, in addition to those previously described, consists of in that the unit 1 with the merchandise compartments 2 may initially be employed without the closure plate 13 and, in case of need, be later provided with the additional equipment when it appears to be suitable to the operator.

While there has been shown what is considered to be the preferred embodiment of the invention, it will be obvious that modifications may be made which come within the scope of the disclosure of the specification.

What is claimed is:

1. In a merchandise compartmenting arrangement for an automatic vending machine of merchandise packages; including actuating means operatively associated with merchandise compartments for dispensing the merchandise packages; at least one of said merchandise compartments being constructed as an independent self-supporting unit which is fillable with merchandise packages externally and separately from said vending machine, and is separately transportable with regard to the latter and insertable therein for filling of the vending machine with merchandise packages; means for receiving said unit in said machine in an operative position for the dispensing of packages by operation of said actuating means, said unit having a dispensing aperture through which the merchandise packages are dispensable singly responsive to operation of said actuating means when the unit is in said operative position within said vending machine, the improvement wherein said unit has a front opening extending substantially the entire height of the unit for filling the unit with merchandise packages, said dispensing aperture being formed by a lower portion of said front opening, a cover plate for said unit extending substantially the entire height thereof and having an open position for filling the unit with merchandise packages through said front opening, and a closed position to enclose the packages in said unit during transport thereof, said cover plate covering said dispensing aperture in said closed position, means slidably supporting said cover plate for longitudinal movement thereof in the plane of the front opening, and projecting means on said cover plate for being operatively engaged when the unit is inserted into the machine to effect longitudinal upwards displacement of the cover plate relative to the unit to expose said dispensing aperture.

2. The improvement as claimed in claim 1 wherein said unit is lowered into said machine to reach said operative position and is raised from the machine for re-filling of the merchandise packages, said projecting means comprising a front projection on said cover plate positioned to be stopped as the unit is being lowered such that further lowering of the unit progressively exposes the dispensing aperture.

3. The improvement as claimed in claim 2 wherein said front projection rests on a stop when the unit is in said operative position, said cover plate dropping by gravity to its closed position when the unit is raised from the machine.

4. The improvement as claimed in claim 1 wherein a plurality of said units are insertable into said machine and collectively include a plurality of said merchandise compartments in a number corresponding to the number of merchandise compartments provided in said vending machine.

5. The improvement as claimed in claim 1 comprising a merchandise ejector operatively associated with a respective one of said merchandise compartments, each said ejector being movable in the operative position of said unit for dispensing the merchandise packages through a recess provided in said unit opposite said cover plate and through a slot provided in the floor of said unit.

6. The improvement as claimed in claim 1 wherein said cover plate is slidable vertically at the front of said unit, said cover plate having an upper end and including an angle portion at said upper end which rests on said unit when the cover plate is in said closed position.

7. The improvement as claimed in claim 1 comprising a coin collecting box secured to said unit laterally thereof for being located below a coin channel provided in said machine when said unit is in said operative position.

8. The improvement as claimed in claim 2 comprising a handle pivotably secured to said unit at the front thereof for being engaged to insert and remove said unit with respect to said machine.

9. The improvement as claimed in claim 1 comprising retaining means including a support in said machine for fastening said unit therein, said unit including a hook on the back of the unit for engaging said support when said unit is introduced into said machine and after said projecting means on the cover plate has been operatively engaged, said unit being pivotable on said support to be fully introduced into said machine, said retaining means comprising a second support vertically located above the first support, said unit including means for engaging the second support when said unit is pivoted and fully introduced into said machine.

10. The improvement as claimed in claim 9 wherein the means for engaging the second support comprises a pair of resilient rollers for clampingly engaging said second support.

* * * * *